United States Patent [19]

Jensen et al.

[11] Patent Number: 4,492,040

[45] Date of Patent: Jan. 8, 1985

[54] METHOD AND APPARATUS FOR DRYING A PULVERULENT OR PARTICULATE PRODUCT

[75] Inventors: Uffe L. Jensen, Vanlφse; Sten Mortensen, Vaerlφse, both of Denmark

[73] Assignee: A/S Niro Atomizer, Soborg, Denmark

[21] Appl. No.: 322,707

[22] Filed: Nov. 18, 1981

[30] Foreign Application Priority Data

Nov. 20, 1980 [DK] Denmark ..... 4964/80

[51] Int. Cl.[3] ..... F26B 3/08; F26B 17/00

[52] U.S. Cl. ..... 34/10; 34/48; 34/57 A; 432/15; 432/58

[58] Field of Search ..... 34/10, 48, 57 A, 57 C, 34/57 R; 432/15, 58; 110/245; 122/4 D; 406/88, 89

[56] References Cited

U.S. PATENT DOCUMENTS

| | | | |
|---|---|---|---|
| 2,378,157 | 6/1945 | Ramseyer et al. | 34/231 |
| 3,186,102 | 6/1965 | Brociner et al. | 34/48 |
| 3,861,054 | 1/1975 | Stahl | 34/48 |
| 3,861,058 | 1/1975 | Whelan | 34/10 |
| 3,893,426 | 7/1975 | Bryers | 110/245 |
| 3,908,284 | 9/1975 | Beranek et al. | 34/57 A |

FOREIGN PATENT DOCUMENTS

| | | | |
|---|---|---|---|
| 1410793 | 10/1975 | United Kingdom | 34/57 R |

*Primary Examiner*—Larry I. Schwartz
*Assistant Examiner*—David W. Westphal
*Attorney, Agent, or Firm*—Dennison, Meserole, Pollack & Scheiner

[57] ABSTRACT

A fluid bed dryer comprises a pre-dryer of the back mixed type and a post-dryer of the plug flow-type. In the pre-dryer the main part of heat is transferred to the product being dried by means of heating panels arranged above the bed plate. A control bed is interposed between the pre-dryer and the post-dryer and includes one or more temperature sensors for sensing the temperature of the product in the control bed. Heat supply to the heating panels is controlled in response to the temperature sensed by the sensor or sensors in order to maintain the product temperature in the pre-dryer at the dew point and so as to ensure that the drying process proceeds within the region of constant drying rate, and that the product contains little or substantially no unbound moisture despite possible changes in product fed to the pre-dryer.

13 Claims, 7 Drawing Figures

METHOD AND APPARATUS FOR DRYING A PULVERULENT OR PARTICULATE PRODUCT

BACKGROUND OF THE INVENTION

1. Field of the Invention

The present invention relates to a method and apparatus for drying a pulverulent or particulate product in a fluid bed dryer with back mixed solids flow.

When a wet product is to be dried in a fluid bed dryer of the said type the amount of heated fluidizing gas supplied to the fluid bed is advantageously kept at a minimum necessary to fluidize the product, and additional heat is then transferred to the fluidized product by means of heating surfaces submerged in the fluidized product layer.

For economic reasons, it is desired to maintain the temperature of the fluidizing gas discharged from the fluid bed and, consequently, also the temperature of the product being dried, substantially at the dew point. To obtain a uniform product of controlled properties it is important that the product discharged from the fluid bed has a degree of moisture which is substantially constant even when the rate of feeding the product to the fluid bed as well as the conditions of the product feed, such as degree of moisture and temperature, vary within certain limits. This may be obtained by controlling the heat transferred to the wet product from the heating surfaces submerged in the fluidized product.

2. Description of the Prior Art

In a known drying method of the above type, the heat transfer from the heating surfaces to the wet product is controlled by the operator so as to maintain the temperature of the drying gas discharged from the fluid bed at a predetermined value. This predetermined value which is calculated to be slightly above the dew point of the discharged fluidizing gas (for example by about 5° C.) is based on an estimated degree of moisture of the product and on an expected rate of feeding the product to the bed. The expected level of the discharge gas temperature should secure that all free surface moisture has been evaporated from the product when the product leaves the fluid bed. However, in practice the moisture and/or the feeding rate of the product may substantially exceed the expected values and to such an extent that the product cannot be maintained in a fluidized condition, whereby the drying process is discontinued, or the moisture and the feeding rate may be less than expected, whereby the heat economy of the drying process is reduced. In any case, it is not possible to obtain a uniformly, dried product.

SUMMARY OF THE INVENTION

The present invention provides a method of the above type permitting an improved control of the supply of heat to the product to be dried so as to reduce the risk of interruption of the drying process and so as to obtain a more uniform final product as well as improved heat economy.

The invention provides a method of drying a pulverulent or particulate product, said method comprising (a)feeding said product to a first back mixed fluid bed, (b) supplying fluidizing gas upwardly through said first bed so as to fluidize said product therein, (c) continuously discharging gas from said first fluid bed, (d) continuously mixing said product in said first bed, (e) supplying heat to said fluidized product in said first bed, (f) continuously discharging product from said first bed through a product outlet, and passing the product discharged through said outlet along a path defined in a second fluid bed so as to produce plug flow, (g) fluidizing said discharged product in said second bed, and (h) controlling said heat supply to the product in said first bed in response to the temperature of said product at least at one location along said path so as to substantially maintain the gas discharged from said first bed in such a condition that it is substantially saturated with vapour, and so as to obtain a desired degree of dryness of said product discharged through said outlet.

In the method according to the invention, the temperature of the drying gas discharged from the said first bed is maintained substantially constant, preferably at the dew point of the drying gas, and, consequently, the temperature of the product discharged from the said first bed is also maintained at substantially the same constant temperature. The supply of heat to the product in said first bed is preferably controlled so that substantially all free or unbound moisture has been evaporated from the product discharged from the said first bed, which means that the drying process in the said first bed proceeds within the socalled "constant rate drying region". When the product is discharged from the said first bed and containing little or substantially no free moisture is passed along the said path in the second fluid bed, the temperature of the product will change because drying is now proceeding within the socalled "falling rate drying region". The temperature of the fluidizing drying gas supplied to the said second fluid bed is preferably maintained at a substantially constant temperature. In this case the temperature of the product at a certain location or at certain locations along the said path in said second bed varies in response to any variations in the feed of product to said first bed, such as variations in feeding rate, temperature of the feed and/or the degree of moisture of the feed. Therefore, if the supply of heat to the product in the first fluid bed is controlled so as to maintain the temperature of the product substantially constant at the said location or locations, the outlet temperature of the fluidizing or drying gas and the dryness of the product discharged from the first fluid bed may be maintained at the desired constant value. It will be understood that the amount and/or temperature of the fluidizing or drying gas supplied to said second bed need not necessarily be maintained constant, but may vary in a predetermined or registerable manner. This predetermined or registered temperature variation could then be taken into account when the heat supply to the product in the first fluid bed is controlled.

Normally, heat is supplied to the product in said first bed partly by means of the fluidizing or drying gas, but mainly by means of heating surfaces arranged above the bed plate of the first fluid bed. In principle, the heat supplied to the product in the first bed may be controlled by controlling the temperature of the fluidizing gas as well as the temperature of the said heating surfaces. However, it is preferred to maintain the temperature of the drying or fluidizing gas substantially constant and to control only the temperature of the heating surfaces. In this case dyring gas is preferably supplied to said first and second beds from a common source.

In the second fluid bed, the product is preferably heated only by means of the fluidizing gas. Therefore, when the product which has been partly dried in the first fluid bed, passes into the second fluid bed the moisture will evaporate at such a rate that to begin with the temperature of the product will normally decrease. As the product proceeds along its path in the second fluid bed, the moisture remaining in the product will be the moisture which is more firmly bound to the product by capillary forces and/or chemical bonds. Therefore, eventually, the rate of evaporation will decrease and, consequently, the temperature of the product will increase. According to the invention, the said one location at which the product temperature is sensed for controlling the supply of heat to the product in the first fluid bed in dependency of said product temperature is preferably positioned downstream of the location at which said minimum temperature is obtained. Thereby it is ensured that at said one location the moisture content of the product has been reduced to such an extent that the temperature of the product will change in response to changes in supply of heat and in the feed of product to the first fluid bed.

The heat supply to the first bed may be controlled in any suitable manner in dependency of the product temperature at said one location. Thus, the temperature control may take place manually or by automatically operating mechanical, electrical, or electronic control means. According to an embodiment of the invention, the product temperature may be sensed at each of a plurality of locations along the said path in said second bed, and the temperature values sensed may then suitably be supplied to a computing device for evaluating these temperature values and for controlling the heat supply to the first fluid bed on the basis of predetermined relations between the temperature variation pattern and the necessary or desirable adjustments of the heat supply.

Normally, the path defined in said second bed is so short that drying in that bed proceeds only slightly beyond the region of constant drying rate.

If the drying process comprises drying in said first and second beds only, the major use of the process is drying of pulverulent or particulate products which may be considered finished products when they have reached the stage where the moisture which is unbound, or slightly more has been removed. In case a higher degree of dryness of the finished product is desired, the drying process may be continued in a further drying stage. Thus, according to one embodiment of the invention the product to be dried may be passed from said first bed to a third fluid bed or another dryer via said path along said second bed. The said beds may then be parts of a fluid bed contact dryer in which the first bed constitutes a pre-drying stage substantially within the region of constant drying rate, while the third bed constitutes a post-drying stage which is preferably in the form of a so-called plug flow fluid bed where the drying takes place substantially within the region of falling drying rate.

The invention also relates to an apparatus for drying a particulate or pulverulent product, said apparatus comprising a first back mixed fluid bed having a product outlet, a second fluid bed communicating with said product outlet and defining an elongated product path producing plug flow, means for feeding a pulverulent or particulate product to said first bed, means for supplying fluidizing gas upwardly through said first bed, heating elements for supplying heat to the product in said first bed, and means for controlling the supply of heat to said heating elements including temperature sensing means arranged at least at one location along said path for controlling said heat supply to said heating elements in response to the temperature sensed at said location.

BRIEF DESCRIPTION OF THE DRAWING

The invention will now be further described with reference to the drawings, wherein.

DESCRIPTION OF THE PREFERRED EMBODIMENT

Figure 1:
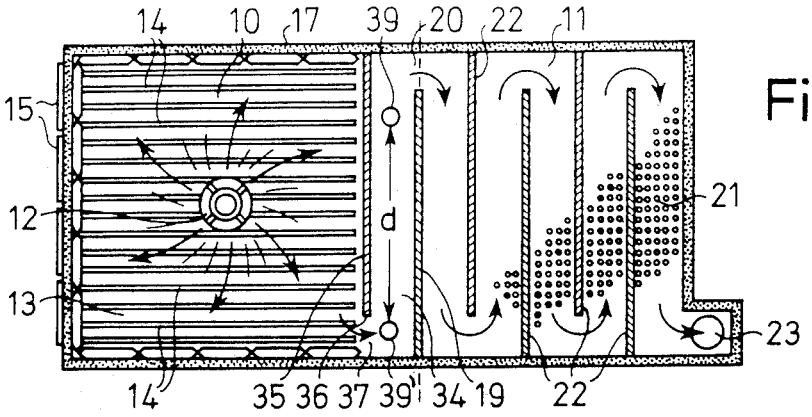
FIG. 1 is a diagrammatic and sectional view of an embodiment of the apparatus according to the invention.

FIG. 1 diagrammatically illustrates a fluid bed dryer comprising a pre-dryer 10 and a post-dryer 11. The pre-dryer 10 is preferably a fluid bed contact dryer of the back mixed type, in which wet pulverulent or particulate material is supplied to the dryer by means of a distributor, preferably a rotary distributor 12 positioned substantially centrally above a first fluid bed plate 13. A plurality of laterally spaced heating elements or heating panels 14 are arranged above the bed plate 13. As best illustrated in FIG. 7, the heating panels 14 are divided into a number of groups, and the panels 14 in each group are interconnected by means of a transverse wall part 15 so as to form a bank or heating unit 16 which may be removed from the dryer as indicated in FIG. 7, for example for the purpose of cleaning, or repair, maintenance, or replacement.

Figure 7:
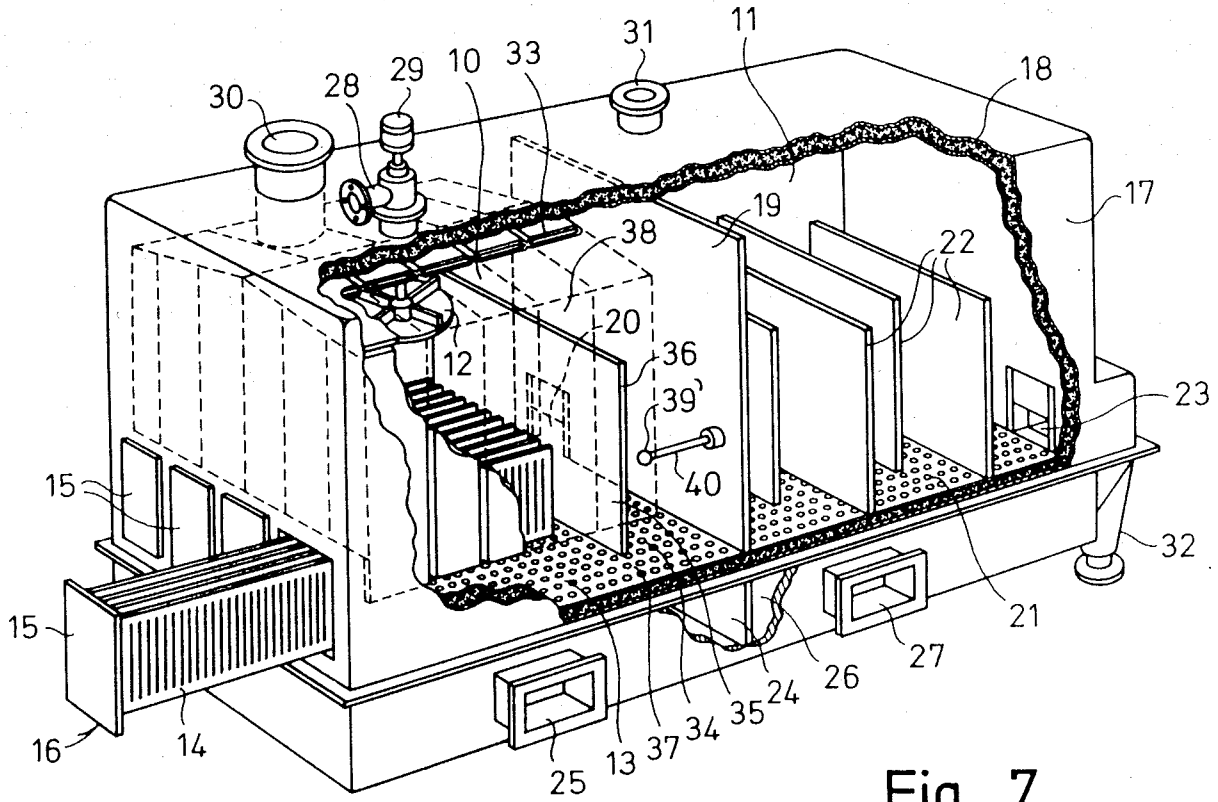
FIG. 7 is a perspective view of a preferred embodiment of the apparatus according to the invention, certain wall parts having been cut away.

The pre-dryer 10 and the post-dryer 11 have a common housing 17 including a heat insulating material 18, vide FIG. 7. The inner space of the housing 17 is divided by means of a transverse partition wall 19 which separates the pre-dryer 10 from the post-dryer 11. However, these dryers 10 and 11 are interconnected by an opening 20 defined in the partition wall 19 at the bottom and at one end thereof.

The post-dryer 11 includes a second fluid bed of the so-called plug flow type with a bed plate 21. A plurality of parallel baffle walls 22 define a tortuous path for the fluidized material moving through the post-dryer 11 from the opening 20 to an outlet 23 for dried material. Warm fluidizing gas for fluidizing the material on the first bed plate 13 is supplied to a first gas chamber 24 located below the bed plate 13 via a first gas inlet 25. Similarly, fluidizing gas for fluidizing the material on the post-dryer bed plate 21 is supplied to a second gas chamber 26 via a second gas inlet 27.

Wet pulverulent or particulate material or product to be dried is supplied to the rotary distributor 12 through a flanged pipe stub 28, and the distributor 12 is driven by an electric motor 29. Exhaust fluidizing gas or air is discharged from the pre-dryer 10 and the post-dryer 11 through first and second gas outlets 30 and 31, respectively, and dried product may be removed from the apparatus through a flanged, tapered product outlet tube 32 communicating with the outlet opening 23. In order to avoid generation of condensate on the inner surface of the housing walls defining the pre-dryer 10, the inner surface of the upper part of these housing walls may be covered by hollow heating panels 33 as indicated by broken lines in FIG. 7. The heat panels 33 as well as the heating elements 14 may be heated in any suitable manner, for example by means of electric current or heated gas or air. However, the elements 14 and the panels 33 are preferably heated by means of hot steam or water.

As far as described up till now, the apparatus shown in FIGS. 1 and 7 is substantially conventional.

Figure 2:
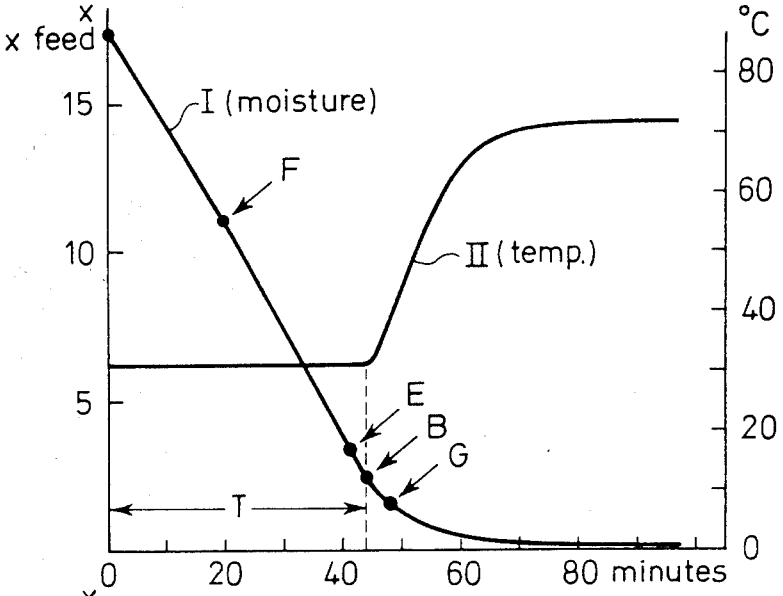
FIG. 2 is a graphic representation of the evaporation process in a batch type fluid bed.

FIG. 2 graphically illustrates the progress of a drying process in which polyvinyl chloride of the suspension type is dried in a fluid bed dryer of the batch type. In FIG. 2, the ordinate x indicates the ratio of the weight of the volatile component to the weight of dry matter in the material to be dried. The curve I shows that during an initial period of time T the ratio x of the volatile component to the dry matter will decrease proportionally to time, and that after a "break point" B the curve I will approach a certain value asymptoticly. The curve II in FIG. 2 shows that during the initial drying period T, the temperature of the material or product being dried will be substantially constant despite variations in the value of x, as long as $x>B$, and thereafter the temperature of the product will rise quickly and then flatten out on a certain level.

Figure 3:
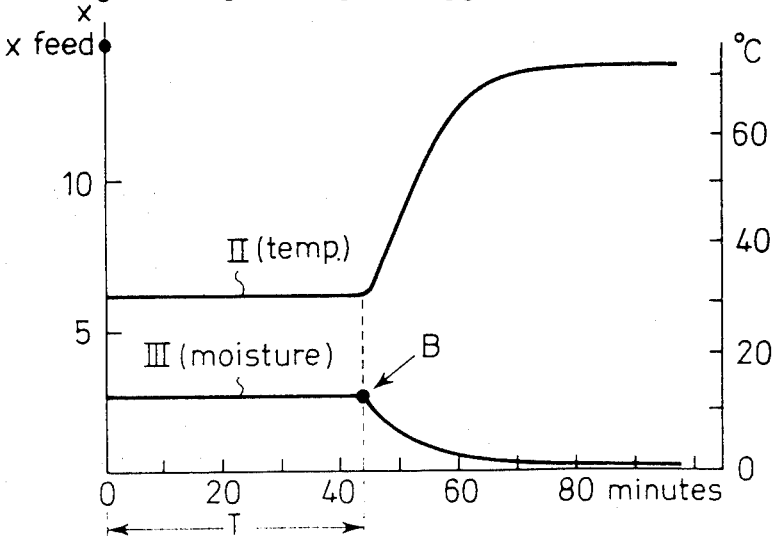
FIG. 3 is a graphic representation of the evaporation process in a continuous fluid bed.

It will be obvious that the same temperature profile would be obtained by passing the product to be dried through an elongated narrow fluid bed of the plug-flow type and letting the longitudinal axis of the bed represent the abscissa. FIG. 3 graphically illustrates the progress of a drying process in which polyvinyl chloride of the suspension type is dried in a fluid bed of the type described above with reference to FIGS. 1 and 7. The time period T is then representing the average residence time of the product in the pre-dryer 10. As in FIG. 2 the ordinate x indicates the ratio of the weight of the volatile component to the weight of dry matter in the material to be dried, e.g. the volatile content of the wet polyvinyl chloride supplied to the pre-dryer 10. The curve III shows that the ratio x is kept on a constant level throughout the pre-dryer. After the "breakpoint" B the curve will proceed as the curve I described above in connection with FIG. 2. The fact that the ratio x is substantially constant for the product residing in the pre-dryer 10 as illustrated by the curve III is evident from a mathematical point of view. When considering a short period of time, the amount of wet cake feed supplied to the pre-dryer can be considered infinitesimal compared to the mass of product contained in the pre-dryer.

For heat economic reasons, the drying in the region of constant drying rate, i.e. during the drying period T, should take place in the pre-dryer 10, and when the break point B has been reached subsequent drying should take place in the post-dryer 11.

When the product or material to be dried is supplied to the pre-dryer 10 by means of the rotary distributor 12, it is normally so wet that the product as such cannot be fluidized in a normal fluid bed until it has reached a point where it has been partially dried. In FIG. 2, this point is indicated as the fluidization point F. However, when the wet product is fed to the pre-dryer 10 which is of the back mixed type, and is distributed over and mixed with fluidized product which has already been partially dried, the wet product may, nevertheless, be fluidized in a satisfactory manner.

In the pre-dryer 10, the amount of warm fluidizing gas or air supplied to the first gas chamber 24 is preferably maintained at a minimum in order to minimize the amount of heat lost with the gas or air discharged from the pre-dryer 10 through the first gas outlet 30. The necessary additional heat is then supplied to the product by means of the heating elements or panels 14.

During the drying process variations may occur, for example in the rate of feeding wet product to the pre-dryer 10 and in the degree of moisture and temperature of the product being fed. As indicated above, it is important to control the supply of heat to the product via the heating panels 14 in response to possible variations in the conditions of the product feed to the pre-dryer 10 so as to secure that product leaving the pre-dryer 10 is always maintained substantially at the breaking point B at which all of the free moisture has been evaporated from the product.

In the apparatus according to the invention a control bed with a bed plate 34 is interposed between the beds 13 and 21 of the pre-dryer 10 and the post-dryer 11, respectively. The control bed is defined between the partition wall 19 and a second partition wall 35 arranged parallel with and transversely spaced from the partition wall 19 so as to define an elongated narrow passage therebetween. A vertical edge portion 36 is spaced from the adjacent inner wall of the housing 17 so as to define a product inlet opening 37 to the control bed plate 34 from the pre-dryer 10. Fluidizing gas is supplied to the control bed via the first gas chamber 24 and from a gas source common with the first fluid bed 13. The gas outlet for the control bed 34 is the same as that of the pre-dryer 10, namely the gas outlet 30 and, therefore, a gas communication opening 36 interconnecting the inner space of the pre-dryer 10 and the control chamber defined between the partition walls 19 and 35 is defined above the upper edge portion of the partition wall 35.

A temperature sensor 39, such as a thermocouple, is arranged above the control bed plate 34 adjacent to the opening 20 communicating the control chamber with the post-dryer 11, and a further temperature sensor 39' may be located at the product inlet opening 37, if desired. As shown in FIG. 7, the temperature sensor or sensors 39 may be mounted on the partition wall 19 and/or 35 by means of a supporting member 40.

The drying apparatus described above operates as follows:

A wet pulverulent or particulate material or product which may, for example, be a suspension type polymer, is continuously supplied through the pipe stub 28 to the rotary distributor 12 which is rotated by the motor 29. The distributor 12 distributes the product substantially uniformly over the total bed plate 13 of the pre-dryer 10, and a flow of warm fluidizing gas or air is supplied to the first gas chamber 24 through the first gas inlet 25 for fluidizing the product on the bed plate 13. The fluidized product on the bed plate 13 comes into contact with the heating panels 14, and as the panels are heated, for example by means of steam, hot water, or hot gas flowing therethrough, heat will continuously be transferred to the fluidized product, not only from the warm fluidizing gas, but to a higher extent from the panels 14. Exhaust fluidizing gas is discharged through the first gas outlet 30 and may be discharged into the atmosphere or recycled for further use after a dehumidification process. When a state of equilibrium has been reached, a product flow corresponding substantially to the product feed through the pipe stub 28 will leave the pre-dryer 10 through product opening 37 and pass along the control bed plate 34. The wet product fed by means of the distributor 12 may be in such a condition that it cannot be fluidized as such. However, as mentioned above, fluidization of the wet product may, nevertheless, be obtained, because the wet product is distributed over and mixed with the partially dried product already present in the bed. In the pre-dryer 10, the product is mixed continuously so that in the condition of equilibrium, the degree of moisture of the mixed product will be substantially the same throughout the fluid bed 12 as explained in connection with FIG. 3.

The supply of heat to the product in the pre-dryer 10 is controlled so that the drying process in the pre-dryer proceeds in the region of constant drying rate which involves that the temperature of the product in the fluid bed above the bed plate 13 and of the fluidizing gas being discharged through the first gas outlet 30 is maintained substantially at the dew point. When the partially dried product leaves the bed plate 13 through the product opening 37 and enters the control bed plate 34, substantially all of the free moisture has been evaporated from the product, so that most of the moisture left is more or less bound to the product, for example by capillary forces or chemical bonds. The partially dried product in the control bed is fluidized by means of fluidizing gas supplied from the first gas chamber 24, which means that fluidizing gas is supplied to the pre-dryer 10 and the control bed from the same source.

Figure 4:
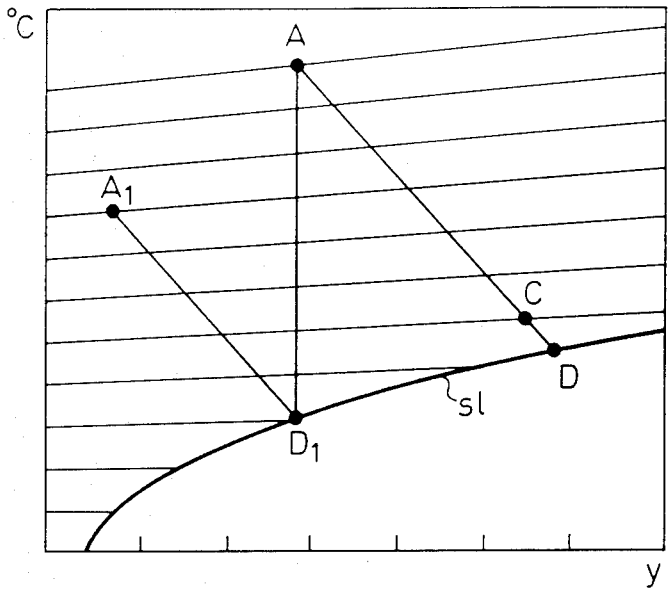
FIG. 4 is a humidity diagram where the interrelations between absolute humidity, temperature, and dew points may be read.

FIG. 4 graphically illustrates the influence on the dew point caused by introduction of heat through heating panels in addition to the heat introduced by the fluidizing gas. In this figure the abscissa value y represents the ratio between the water component and the component of dry air in the drying air or gas, and the ordinate represents the temperature of the drying gas. The curve designated "sl" is the saturation line. Fluidizing gas supplied to the pre-dryer 10 takes up vapour from the humid or wet product in the fluid bed, whereby the gas is cooled off. Assuming that the fluidizing gas is supplied to the pre-dryer at a condition represented by point $A_1$ in FIG. 4, the condition of the gas discharged from the pre-dryer may be represented by point $D_1$ indicating that the temperature of the gas has been decreased to the dew point while the ratio between the water component and the component of dry air has been increased. In principle, the function of the heating panels 14 may be regarded as a reheating of the fluidizing gas or air from the dew point $D_1$ to a higher temperature represented by point A in FIG. 4, and the fluidizing gas is now able to take up more vapour or humidity, whereby the gas is cooled to the dew point indicated by D in FIG. 4. The difference between the abscissa values of the points D and $A_1$ represents the total amount of water or humidity transferred from the product to the fluidizing gas. It is understood that the ultimate dew point D of the gas is dependent on i.a. the surface area, the surface temperature, and the heat transfer coefficient of the heating panels.

Figure 5:
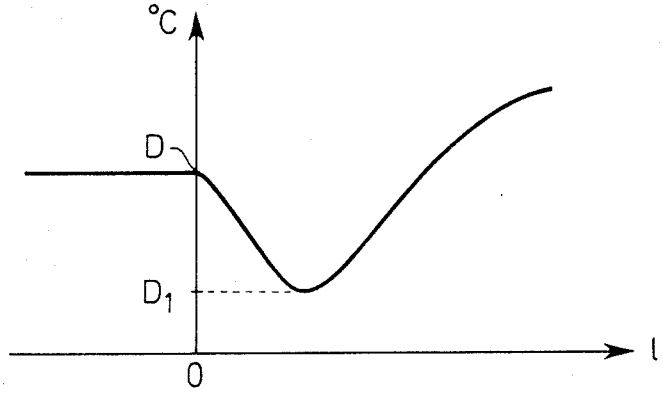
FIGS. 5 and 6 are graphic representations of the variation in temperature of a pulverulent or particulate product moving along a "control bed"

FIG. 5 graphically illustrates the variation in temperature of the product passing the distance d along the control bed 34 from the opening 37 to the opening 20. As mentioned above, it is desired to maintain the temperature of the product leaving the pre-dryer 10 substantially at the dew point D. When the product moves along the first part of the control bed 34, which has no heating panels, the temperature will fall from the value D and approach the value $D_1$ which is the dew point corresponding to the condition represented by $A_1$ in FIG. 4. When the product has passed a certain distance along the control bed 34, only more strongly bound moisture is left in the product, whereby the rate of evaporation decreases, and eventually heat supplied to the product by means of the fluidizing gas will the cause a rise in the product temperature.

Figure 6:
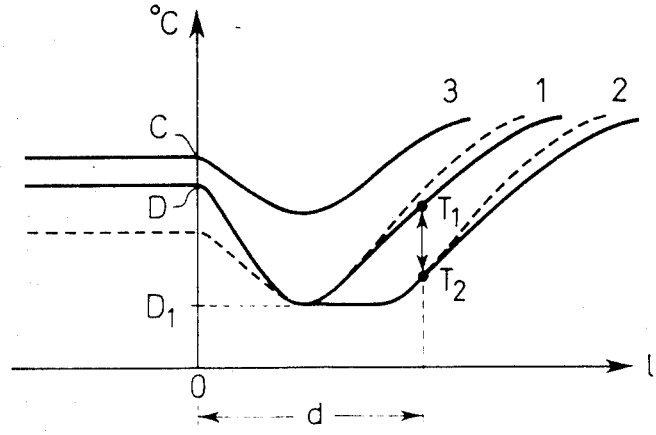

FIG. 6 graphically illustrates the above mentioned fall and rise in product temperature along the control bed 34 in three different situations which will be explained as follows:

D is the dew point of the fluidizing gas within the pre-dryer. If the product enters into the control bed with a moisture content corresponding substantially to, and preferably being slightly above that corresponding to the break point B in FIG. 2, the temperature of the product will fall to the temperature $D_1$ under simultaneous evaporation of the remaining free or less bound water, whereafter the temperature will rise according to curve 1 in FIG. 6. This curve is identical to that shown in FIG. 5. If the product enters into the control bed with a moisture content substantially higher than that corresponding to the break point B, e.g. corresponding to the point E in FIG. 2, the declining part of the curve will be substantially unchanged till $D_1$ is reached. As some less bound water is still present in the product, the drying will proceed at the constant dew point temperature $D_1$ till only the more strongly bound moisture is left, whereafter the temperature will rise as illustrated by the curve 2.

If the pre-dryer is operated so that the moisture content of the product therein is kept at a value G (FIG. 2) which is distinctly lower than B, the product temperature in the pre-dryer will exceed the dew point D and may be represented by the point C in FIG. 4. In this case, when the product enters from the pre-dryer into the control bed, there will not be enough evaporation to develop the full minimum on the temperature curve, and a curve as that indicated by 3 in FIG. 6 will result.

Now, if the temperature sensor 39 is placed in the control bed downstream of the product inlet opening 37 and in a distance d therefrom, the temperature $T_1$ in FIG. 6 will represent the moisture content B, and the temperature $T_2$ will represent the moisture content E. To every moisture content between B and E there will be a corresponding temperature between $T_1$ and $T_2$.

The curves shown in FIG. 6 are typical for normal operation where a rather uniform feed rate of the wet cake or product as well as a rather uniform composition of the wet cake are endeavoured, while deviations of the predetermined values must be expected for various random reasons. Under special conditions, e.g. the start-up procedure, very large variations may occur, and the level of the temperature D may then change considerably. Nevertheless, the temperature $D_1$ will remain substantially constant as it is defined by the substantially constant line $A_1$—$D_1$ in FIG. 4, and the rising part of the curves will keep substantially the same shape as indicated with dotted lines in FIG. 6.

Systems for continuous, direct, and immediate detection of the moisture content of a pulverulent or particulate fluidized product have not yet been developed to a standard which is sufficiently reliable for plain industrial use. However, in the method according to the invention an unpractical humidity measurement has been transformed into a simple, reliable on-line temperature detection.

The location or at least one of the locations at which the temperature in the control bed is measured or detected is preferably positioned downstream of the location at which the minimum temperature is reached, in order to obtain the full developed split of the temperature curves illustrated in FIG. 6.

Normally, it is adequate to use only one temperature sensor, namely the sensor 39 located adjacent to the opening 20. If a decrease in temperature is sensed at that location additional heat must be supplied to the panels 14 in order to restore the previous conditions. The control of heat supply to the panels 14 may be made manually by an operator, or automatically by means of electronic or electric circuits. In the latter case, two temperature sensors 39 and 39' or more may be used for controlling the heat supply to the panels 14.

While in the preferred embodiment fluidizing gas is supplied to the pre-dryer 10 and to the control bed 34 from the same source, it is possible to supply fluidizing gas to the control bed from a separate source. This may, for example, be advantageous if the pre-dryer 10 does not contain heating panels so that control of the supply of heat to the pre-dryer must be performed by controlling the amount and/or temperature of the fluidizing gas supplied to the pre-dryer 10. Furthermore, while it is preferred to maintain the conditions at which fluidizing gas is supplied to the pre-heater 10 and to the control bed constant, these conditions may vary provided that these variations are predetermined or registered so that they may be taken into account when the supply of heat to the pre-dryer 10 is controlled on the basis of the temperature sensed by the temperature sensor 39 or sensors 39, 39'. The heat supply to the panel 14 may then be controlled by means of a suitable computer evaluating the signals received from the sensors 39, 39' and from possible measuring devices surveying the conditions of fluidizing gas supply to the pre-dryer 10 and to the control bed 34. The fluidizing gas flowing upwardly through the control bed 34 may flow into the pre-dryer 10 via the communication opening 38 and may then be discharged through the gas outlet 30.

From the control bed 34 the product passes into the post-dryer 11 through the opening 20. In the dryer 11, the product which is fluidized by fluidizing gas supplied to the chamber 26 through the gas inlet 27, follows the tortuous path defined by the baffle walls 22. In the post-dryer 11 the drying process takes place in the falling rate drying regime, and heat is normally supplied only by means of a fluidizing gas. However, heat may also be supplied to the product by heating the baffle walls 22, if desired. When the product has travelled along the total path defined by the baffle walls 22 it is discharged from the apparatus through the product outlet 23 and the tube 32 in the desired dried condition. The residence time is adjusted to obtain the desired final moisture content.

EXAMPLE

During a starting-up period comprising several hours, a continuous flow of wet polyvinyl chloride of the suspension type in an average amount of 13500 kg/h was supplied to the distributor 12 of an apparatus of the type illustrated in FIGS. 1 and 7. Fluidizing air at temperature of about 100° C. was supplied to the gas chamber 24. The panels 14 were heated to a temperature of about 100° C. by means of steam, and fluidizing air was discharged through the gas outlet 30 at a temperature corresponding to the dew point.

The product feed to the distributor 12 contained about 26 percent by weight of water and 74 percent by weight of solid matter, and the temperature of the product fed to the distributor was about 40° C. However, within the said period of time the amount of product fed to the distributor varied from 5000 kg/h to 10,000 kg/h, the temperature of the product feed varied from 30° C. to 50° C., and the moisture content of the product feed varied from 30 percent by weight to 40 percent by weight. The temperature of the product in the control bed 34 was measured by means of a thermocouple 39 positioned adjacent to the product inlet opening 20 communicating with the post-dryer 11, and the supply of steam to the heating panels 14 was controlled automatically, so that the temperature of the product at the sensor 39 was kept substantially constant.

The temperature and the degree of moisture of the product discharged from the pre-dryer 10 through the opening 37 was measured, and it was found that within the said period of time, the temperature varied from 45° C. to 59° C., and the degree of moisture varied from 2.5 percent by weight to 2.7 percent by weight.

Fluidizing gas was supplied to the gas chamber 26 of the post-dryer 11 at a temperature of 75° C., and the product was discharged through the outlet tube 32 with a degree of moisture of 0.2 percent by weight and at a temperature of 45° C. Fluidizing gas was discharged through the gas outlet 31 at a temperature of 41° C.

For comparison, in a conventional apparatus or plant of the same type operated under similar conditions, the degree of moisture of the product discharged from the pre-dryer varies within a rather wide range, typically from 0.2–10 percent by weight. Thus, the method and apparatus according to the invention makes it possible to obtain a much more uniform moisture content of the product discharged from the pre-dryer than possible by using the conventional technique.

It should be understood that various changes and modifications of the method and apparatus described above could be made within the scope of the present invention. For example, fluidizing gas could be supplied to the control bed 34 and to the post-dryer 11 from the same source. Furthermore, the post-dryer 11 may be dispensed with in cases where the dryness of the product leaving the control bed 34 is considered sufficient for the intended purpose.

We claim:

1. A method of drying a moist particulate product, said method comprising;

(a) feeding said product to a first fluid bed, (b) supplying fluidizing gas upwardly through said first bed so as to fluidize said product therein, (c) supplying heat to said fluidized product in said first bed, (d) continuously discharging product from said first bed through a product outlet, and passing the product discharged through said outlet along a path defined in a second fluid bed so as to produce generally plug flow, (e) predetermining said path so that the moisture content of said particulate product encompasses the constant rate drying-falling rate drying region, (f) controlling said heat supply to the product in said first bed in response to the temperature of said product at least at one location along said path so as to obtain a desired degree of dryness of said product discharged through said outlet substantially free of unbound moisture, and (g) wherein the product temperature varies and passes a minimum while the product travels along said path on said second bed, said one location being positioned downstream of the location at which said minimum temperature is reached.

2. A method according to claim 1, wherein said heat supply is controlled so as to maintain the product at said one location at a substantially constant temperature.

3. A method according to claim 1, wherein fluidizing gas is supplied to said first and second beds from a common source.

4. A method according to claim 1, wherein said heat supply is controlled in response to the product temperatures at a plurality of locations along said path.

5. A method according to claim 1, wherein said product in said first bed is heated by means of heating panels contacting the fluidized product, said heat supply to said product being controlled by controlling supply of heat to said panels.

6. A method according to claim 1, wherein said product is passed from said first bed to a third fluid bed or another dryer via said path along said second bed.

7. A method according to claim 1 wherein in step (a) said product is fed to a back mixed fluid bed.

8. An apparatus for drying a particulate or pulverulent product, said apparatus comprising a first fluid bed having a product outlet, a second fluid bed communicating with said product outlet and defining an elongated product path producing generally plug flow, means for feeding a pulverulent or particulate product to said first bed, means for supplying fluidizing gas upwardly through said first bed, means for supplying fluidizing gas to said second bed with a generally constant rate and temperature, and means for controlling supply of heat to said first bed including product temperature sensing means arranged at least at one location along said path for controlling said heat supply to said first bed in response to the temperature sensed at said location whereby in use, the product being discharged from said product outlet is substantially free of unbound moisture, whereby the temperature sensed is indicative of the moisture content of the particulate product in the region encompassing constant rate drying-falling rate drying, and said sensing means being positioned in the falling rate drying region or equivalently being positioned at a location after which a minimum temperature of the product has been reached.

9. An apparatus according to claim 8, wherein said first and second beds communicate with a common source for fluidizing gas.

10. An apparatus according to claim 8, wherein said control means comprise a plurality of temperature sensing means mutually spaced along said path.

11. An apparatus according to claim 8, wherein said second fluid bed interconnects said first bed and a third fluid bed.

12. An apparatus according to claim 8 including heating elements for supplying heat to the product in said first bed.

13. An apparatus according to claim 8 wherein said first fluid bed is a back mixed fluid bed.

* * * * *